US005103615A

United States Patent [19]

Owens

[11] Patent Number: 5,103,615

[45] Date of Patent: Apr. 14, 1992

[54] PLUG

[76] Inventor: John D. Owens, 509 Lakeview Ave., Seffner, Fla. 33584

[21] Appl. No.: 750,323

[22] Filed: Aug. 27, 1991

[51] Int. Cl.[5] ..... E04G 23/02; E04B 1/72

[52] U.S. Cl. ..... 52/514; 52/169.14

[58] Field of Search ..... 52/514, 101, 302, 303, 52/169.14; 114/227; 152/370; 215/358, 359, 361

[56] References Cited

U.S. PATENT DOCUMENTS

| | | | |
|---|---|---|---|
| 256,567 | 4/1882 | Holmes | 52/514 |
| 896,850 | 8/1908 | Mundey | 152/370 |
| 4,301,629 | 11/1981 | Farr | 52/514 X |
| 4,754,590 | 7/1988 | Gordon | 52/514 X |
| 4,807,415 | 2/1989 | Oak | 52/101 X |

*Primary Examiner*—David A. Scherbel

*Assistant Examiner*—Robert Canfield

*Attorney, Agent, or Firm*—Arthur W. Fisher, III

[57] ABSTRACT

A plug for sealing holes in a building structure to prevent seepage of water and vapor after chemical treatment of the building structure comprising an outer flexible sealing cap movable between a sealed and unsealed position deformable from a substantially concave configuration when in the unsealed position to a substantially flat configuration when in the sealed position such that the lower surface of the outer flexible sealing cap engages the surface of the building structure adjacent the periphery of the hole when in the sealed position to seal the hole and a pair of flexible anchoring members to be disposed in the hole to engage the inner wall for the hole to anchor the plug therein to retain the outer flexible sealing cap in the sealed position.

8 Claims, 2 Drawing Sheets

PLUG

BACKGROUND OF THE INVENTION

1. Field of the Invention

A plug for sealing holes in a building structure to prevent seepage of water and vapor after chemical treatment of the building structure.

2. Description of the Prior Art

Chemically treating buildings for termites and other insects is common. This is generally accomplished by drilling holes through floors, crawl space floors and/or walls and injecting chemicals to kill the termites. The holes must be sealed against water and chemical seepage.

This is often accomplished by inserting a cork into the holes. Unfortunately, the corks do not provide a satisfactory seal. In addition, efforts have been made to use plastic plugs. Achieving and maintaining an effective seal with plastic plugs in a damp environment is difficult.

U.S. Pat. No. 4,807,415 shows a plug for sealing holes in concrete to prevent ingress of water and/or vapor after chemical treatment for termites comprising a cylindrical tapered plug body and a sealing lip flaring outwardly at the top end. The plug includes a mold release to aid in insertion into the holes and a fungicide to prevent growth of mold and algae.

U.S. Pat. No. 4,301,629 teaches a water-tight plug to close and seal holes drilled through the exterior wall surface of structure during installation of insulation material comprising fluid-tight sealing means provided adjacent a head of the plug sandwiched during plug installation between a surface around the periphery of a hole and the plug head.

U.S. Pat. No. 4,811,531 relates to a device for inserting a cork plug into a hole to a predetermined depth made in the foundation of a building for termite control comprising a rod for partial insertion into the hole and a pin mounted on the bottom end of the rod so that a cork plug may be mounted thereto. Depth-setting means is mounted to the rod for varying the extent to which the rod can be inserted into the hole. The rod has a plurality of transverse holes uniformly spaced along its longitudinal axis and the depth-setting means includes a depth-setting pin for removable insertion into one of the transverse holes and a depth-setting cap removably mounted to the depth-setting pin for use in securing the depth-setting pin in the selected transverse hole. In an alternate embodiment, the rod has an externally threaded region and the depth-setting means includes a winged nut for threaded engagement on the externally threaded region.

SUMMARY OF THE INVENTION

The present invention relates to a plug to seal hole(s) drilled into a building structure in treating for termite infestation and the like.

The plug comprises an outer flexible sealing cap movable between a sealed and unsealed position having a pair of flexible anchor members affixed to the lower surface thereof to cooperatively form a channel therebetween. Each flexible anchor member comprises an intermediate flexible element having an inner enlarged anchor element surface formed on the inner end thereof.

The plug is installed in the hole by inserting and driving the inner enlarged anchor elements into the hole. 14 The channel permits the intermediate flexible elements to flex inwardly relative to each other when the inner enlarged anchor elements engage the inner surface or wall of the hole to anchor the plug within the hole. When so positioned, the outer flexible sealing cap is disposed in the sealed position such that the lower surface thereof engages and seals the surface of the building structure adjacent the periphery of the hole.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
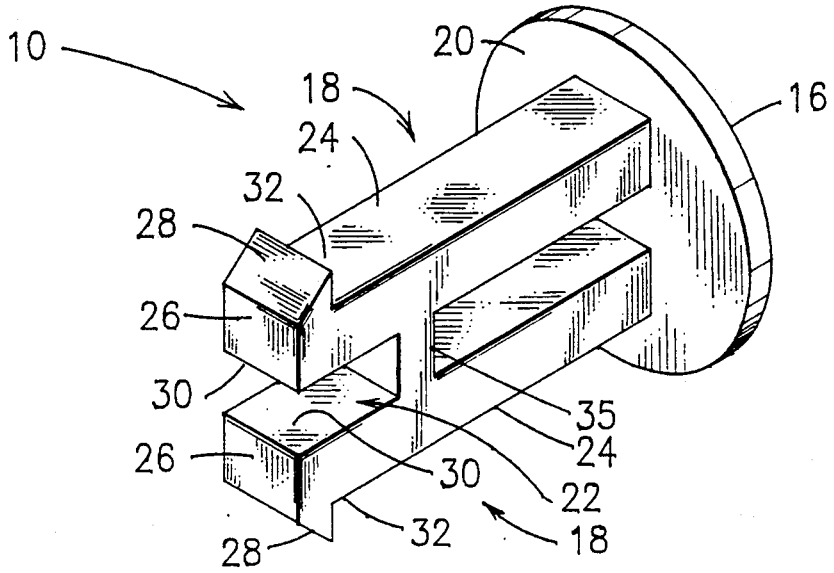
FIG. 1 is a perspective of the plug.
Figure 2:
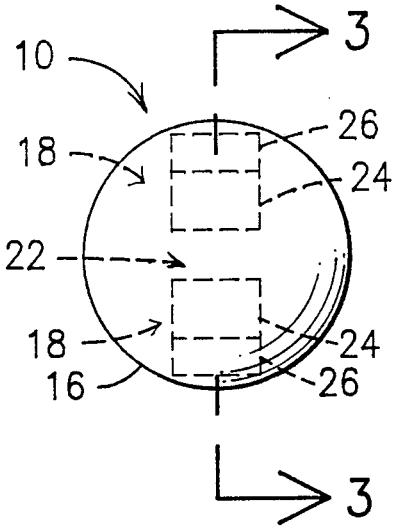
FIG. 2 is a top view of the plug.

As shown in FIGS. 1 through 4, the present invention relates to a plug generally indicated as 10 to seal hole(s) 12 drilled into a building structure 14 that provide access to inject pesticides used in treating termite infestation and the like. Common hole sizes range from a one-quarter inch to three quarters inch. Such holes are usually irregular. Thus the plug 10 must be configured to prevent seepage of water and chemical vapor from the hole(s) 12 over a relatively broad range of sizes.

As shown in FIGS. 1 through 4, the plug 10 comprises an outer flexible sealing cap 16 movable between a flat, sealed and a concave, unsealed position having a pair of flexible anchor members each generally indicated as 18 affixed in spaced relationship relative to each other to the lower surface 20 of the outer flexible sealing cap 16 to cooperatively form a channel 22 therebetween. Each flexible anchor member 18 comprises an intermediate flexible element 24 extending outwardly from the lower surface 20 having an inner enlarged anchor element 26 including an inclined alignment anchor surface 28 formed on the inner end 30 thereof and extending outwardly from the side 32 thereof.

Figure 3:
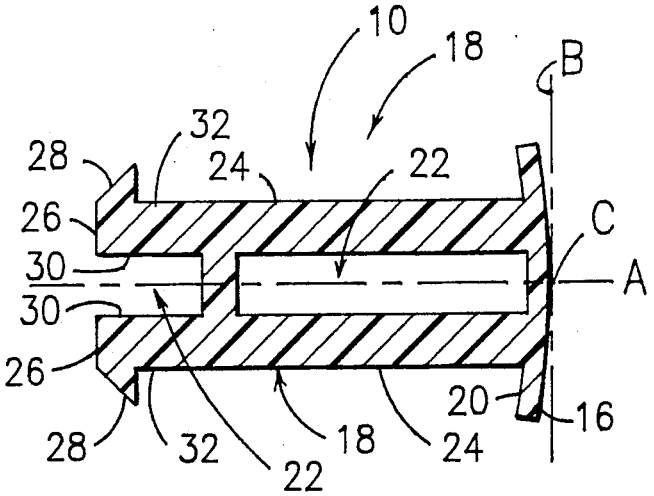
FIG. 3 is a sectional side elevation view of the plug taken along 3—3 of FIG. 2 in the unsealed position.

As best shown in FIG. 3, the central longitudinal axis A of the channel 22 is substantially perpendicular to the plane B of the tangent to the center C of the outer flexible sealing cap 16.

Figure 4:
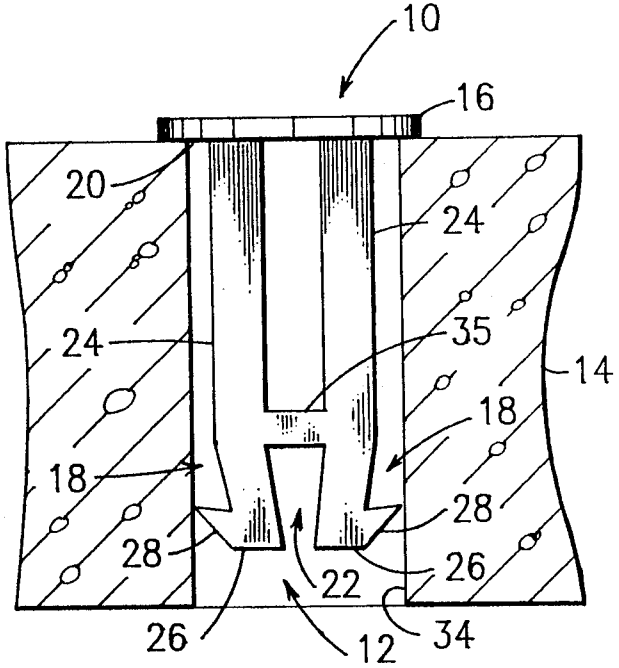
FIG. 4 is a side elevation view of the plug installed in the sealed position.

As shown in FIG. 4, the plug 10 is installed in the hole 12 by inserting and driving the inner enlarged anchor elements 26 into the hole 12. The inclined alignment anchor surfaces 28 assist in aligning and positioning the plug 10 in the hole 12. The channel 22 permits the intermediate flexible elements 24 to flex inwardly relative to each other when the inner enlarged anchor elements 26 engage the inner surface or wall 34 of the hole 12 to anchor the plug 10 within the hole 12. A cross-member 35 extends between the intermediate flexible elements 24 to maintain the intermediate flexible elements 24 in substantially parallel relationship relative to each other prior to installation of the plug 10 in the hole 12. When so positioned, the outer flexible sealing cap 16 is disposed in the substantially flat sealed position such that the lower surface 20 thereof engages and seals the surface of the building structure adjacent the periphery of the hole 12.

Figure 5:
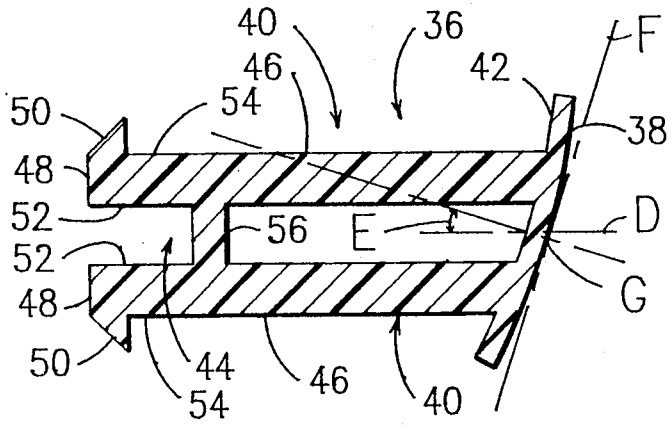
FIG. 5 is a sectional side elevation view of an alternate embodiment of the plug in the unsealed position.
Figure 6:
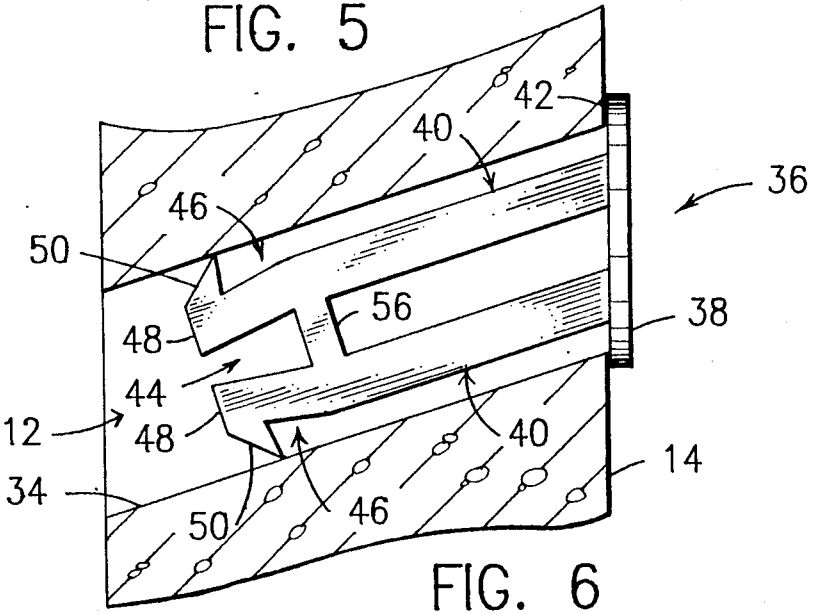
FIG. 6 is a side elevation view of the alternate embodiment of the plug installed in the sealed position.

FIGS. 5 and 6 show an alternate embodiment of the plug generally indicated as 36. The plug 36 comprises an outer concave flexible sealing cap 38 movable between a sealed, flat and a concave, unsealed position having a pair of flexible anchor members each generally indicated as 40 affixed in spaced relationship relative to each other to the lower surface 42 of the outer flexible sealing cap 38 to cooperatively form a channel 44 therebetween. Each flexible anchor member 40 comprises an intermediate flexible element 46 extending outwardly from the lower surface 42 having an inner enlarged anchor element 48 including an inclined alignment anchor surface 50 formed on the inner end 52 thereof and extending outwardly from the side 54 thereof.

As best shown in FIG. 5, the central longitudinal axis D of the channel 44 forms an angle E of substantially thirty degrees with the plane F of the tangent to the center G the outer flexible sealing cap 38.

As best shown in FIG. 6, the plug 36 is installed in the hole 12 by inserting and driving the inner enlarged anchor elements 48 into the hole 12. The inclined alignment anchor surfaces 50 assist in aligning and positioning the plug 36 in the hole 12. The channel 44 permits the intermediate flexible elements 46 to flex inwardly relative to each other when the inner enlarged anchor elements 48 engage the inner surface or wall 34 of the hole 12 to anchor the plug 36 within the hole 12. A cross-member 56 extends between the intermediate flexible elements 46 to maintain the intermediate flexible elements 46 in substantially parallel relationship relative to each other prior to installation of the plug 36 in the hole 12. When so positioned, the outer flexible sealing cap 38 is disposed in the substantially flat sealed position such that the lower surface 42 thereof engages and seals the surface of the building structure adjacent the periphery of the hole 12.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A plug for sealing holes in a building structure having a wall surface, each hole including an inner wall, to prevent seepage of water and vapor after chemical treatment of the building structure, said plug comprising an outer flexible sealing cap having a lower surface movable between a sealed and unsealed position deformable from a substantially concave configuration when in said unsealed position to a substantially flat configuration when in said sealed position such that said lower surface of said outer flexible sealing cap engages the wall surface of the building structure adjacent the periphery of the hole to be sealed when in said sealed position to seal the hole and an anchoring means to be disposed in the hole to be sealed to engage the inner wall of the hole to anchor said plug therein to retain said outer flexible sealing cap in said sealed position, said anchoring means comprising a pair of flexible anchor members each including a side and an inner end disposed in spaced relationship relative to each other on said outer flexible sealing cap to cooperatively form a channel therebetween such that said channel permits said flexible anchor members to flex inwardly relative to each other when inserted into the hole to be sealed and each said flexible anchor member comprises an intermediate flexible element having an inner enlarged anchor element formed on said inner end thereof and extending outwardly from said side thereof to engage the inner wall of the hole to be sealed.

2. The plug of claim 1 wherein each said inner enlarged anchor element includes an inclined alignment anchor surface formed thereon to align said plug relative to the hole to be sealed.

3. The plug of claim 1 further including a cross-member extending between said intermediate flexible elements to maintain said intermediate flexible elements in substantially parallel relationship relative to each other prior to installation of said plug in the hole.

4. The plug of claim 1 wherein the central longitudinal axis of said channel is substantially perpendicular to the plane of the tangent to the center of said outer flexible sealing cap.

5. The plug of claim 1 wherein the central longitudinal axis of said anchoring means is substantially perpendicular to the plane of the tangent to the center of said outer flexible sealing cap.

6. A plug for sealing holes in a building structure having a wall surface, each hole including an inner wall to prevent seepage of water and vapor after chemical treatment of the building structure, said plug comprising an outer flexible sealing cap having a lower surface movable between a sealed and unsealed position deformable from a substantially concave configuration when in said unsealed position to a substantially flat configuration when in said sealed position such that said lower surface of said outer flexible sealing cap engages the wall surface of the building structure adjacent the periphery of the hole to be sealed when in said sealed position to seal the hole and an anchoring means to be disposed in the hole to be sealed to engage the inner wall of the hole to anchor said plug therein to retain said outer flexible sealing cap in said sealed position and wherein the central longitudinal axis of said anchoring means forms an acute angle with the plane of the tangent to the center of said outer flexible sealing cap.

7. The plug of claim 6 wherein the central longitudinal axis of said channel forms an angle of substantially thirty degrees with the plane of the tangent to the center of said outer flexible sealing cap.

8. A plug for sealing holes in a building structure having a wall surface, each hole including an inner wall, to prevent seepage of water and vapor after chemical treatment of the building structure, said plug comprising an outer flexible sealing cap having a lower surface movable between a sealed and unsealed position deformable from a substantially concave configuration when in said unsealed position to a substantially flat configuration when in said sealed position such that said lower surface of said outer flexible sealing cap engages the wall surface of the building structure adjacent the periphery of the hole to be sealed when in said sealed position to seal the hole and an anchoring means to be disposed in the hole to be sealed to engage the inner wall of the hole to anchor said plug therein to retain said outer flexible sealing cap in said sealed position, said anchoring means comprising a pair of flexible anchor members each including a side and an inner end disposed in spaced relationship relative to each other on said outer flexible sealing cap to cooperatively form a channel therebetween such that said channel permits said flexible anchor members to flex inwardly relative to each other when inserted into the hole to be sealed and wherein the central longitudinal axis of said channel forms an angle of substantially thirty degrees with the plane of the tangent to the center of said outer flexible sealing cap.

* * * * *